US007204221B2

(12) United States Patent
Iida et al.

(10) Patent No.: US 7,204,221 B2
(45) Date of Patent: Apr. 17, 2007

(54) CONTROL APPARATUS OF ENGINE OPERATED MACHINE

(75) Inventors: Michihiro Iida, Saitama (JP); Kenji Kamimura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 85 days.

(21) Appl. No.: 10/973,445

(22) Filed: Oct. 27, 2004

(65) Prior Publication Data

US 2005/0093369 A1 May 5, 2005

(30) Foreign Application Priority Data

Oct. 30, 2003 (JP) ..... 2003-370334

(51) Int. Cl.
*F02N 11/12* (2006.01)
*F02N 11/08* (2006.01)

(52) U.S. Cl. ..... 123/179.2

(58) Field of Classification Search ..... 123/179.2
See application file for complete search history.

(56) References Cited

U.S. PATENT DOCUMENTS 2,873,382 A * 2/1959 Herring ..... 290/37 R

FOREIGN PATENT DOCUMENTS

JP 61-29239 7/1986
JP 2003-148311 5/2003

* cited by examiner

*Primary Examiner*—Stephen K. Cronin
*Assistant Examiner*—Arnold Castro
(74) *Attorney, Agent, or Firm*—Westerman, Hattori, Daniels & Adrian, LLP.

(57) ABSTRACT

It is an object of the invention to provide the operability of an engine power generator having a remote controller. A starting switch 90 of a remote controller 9 and a starting switch on a power generator body's side can be operated in parallel. A stopping switch 91 of the remote controller 9 and a stopping switch on the body's side can be operated in parallel. The stopping switch 91 and an oil level switch 26 are connected to each other in parallel. The starting switch 90 and the stopping switch 91 can be operated when a combination switch 12 is in ON position. An engine 2 can be started and stopped by switching operation on the body's side in parallel to remote control operation.

4 Claims, 4 Drawing Sheets

| KEY POSITION \ TERMINAL | IG | E | LO | BAT | ST | FS | G |
|---|---|---|---|---|---|---|---|
| OFF | ○ | ○ | | | | ○ | ○ |
| ON | | | ○ | ○ | | | |
| ST | | | ○ | ○ | ○ | | |

| KEY POSITION \ TERMINAL | IG | E | LO | BAT | ST | FS | G |
|---|---|---|---|---|---|---|---|
| OFF | ○ | ○ | | | | ○ | ○ |
| ON | | | ○ | ○ | | | |
| ST | | | ○ | ○ | ○ | | |

| | IG | E | BAT | ST | FS | G |
|---|---|---|---|---|---|---|
| OFF | ○ | ○ | | | ○ | ○ |
| ON | | | | | | |
| ST | | | ○ | ○ | | |

CONTROL APPARATUS OF ENGINE OPERATED MACHINE

BACKGROUND OF THE INVENTION

1. Field of the Invention

The present invention relates to a control apparatus for controlling start and stop of an engine operated machine, and more particularly, to a control apparatus of an engine operated machine including a remote controller.

2. Description of the Related Art

As for a work machine which is driven or operated by an engine such as an engine power generator, a position where the engine operated machine is disposed and a position where a work is carried out actually using the engine operated machine are separated from each other in many cases. For example, in the work using the engine power generator, an electric powered tool and an illumination lamp in which loads are used at a position away from the power generator in many cases. In such a case, a remote controller can be provided so that the engine power generator can be started and stopped from remote workshop by remote control. For example, Japanese Patent Publication No. S61-29239 and Japanese Patent Application Laid-open No. 2003-148311 disclose engine power generator having remote controllers.

FIG. 4A is a block diagram showing an example of a conventional control apparatus for an engine power generator having a remote controller. In FIG. 4A, a relay box 200 and a remote controller 300 are connected to an engine power generator 100. The relay box 200 is mounted on the power generator 100 or disposed in the vicinity of the power generator 100. The relay box 200 is disposed in an actual workshop in the vicinity of an operator.

The engine power generator 100 includes a self-trigger type ignition 101 having an ignition magnet provided on an outer periphery of a flywheel of the engine (not shown). The ignition 101 obtains ignition energy by electromotive force generated when the flywheel rotates. The engine power generator 100 also includes a battery 102, a starter motor 103, a motor drive relay 104, a fuel-cut solenoid 105, a combination switch 106, a charge coil 107, an auto-choke solenoid valve 108, an oil alert 109, an oil level switch 110 and an ignition plug 111 as electric parts.

The remote controller 300 is provided with a main switch 301, a self-restoring type button switch 302 as a start switch, and a pilot lamp 303. The relay box 200 is provided with a selector switch 201 and relays 202 and 203.

FIG. 4B shows connection at each switching positions of the combination switch 106. At the OFF position (OFF) of the combination switch 106, terminals IG and E are connected to each other, the ignition coil 101 is grounded, terminals FS and G are connected to each other and the solenoid 105 is in a close loop short-circuit state. In the ON position (ON), the each terminals of the combination switch 106 are opened. In the start position (ST), a terminal ST is connected to a terminal BAT and the starter motor 103 is connected to the battery 102.

When the remote control is not carried out, the selector switch 201 of the relay box 200 is switched to a contact b (on the side of the combination switch). In this state, the combination switch 106 provided on the power generator body can be operated, and the engine power generator is started and stopped by the switching operation of the combination switch 106.

When the remote control is carried out, the combination switch 106 is switched to the OFF position. In this state, the selector switch 201 of the relay box 200 is switched to a contact a (on the side of remote controller). With this, the remote controller 300 can be operated. If the main switch 301 of the remote controller 300 is turned ON, current flows from the battery 102 to the coil of the relay 202 through the main switch 301, the relay 202 is switched from the contact b to the contact a, and the grounding state of the ignition coil 101 connected through the combination switch 106 and the closed loop short-circuited state of the fuel-cut solenoid 105 are released.

If the start switch 302 of the remote controller 300 is turned ON, the relay 203 is switched from the contact a to the contact b. This state is maintained while the start switch 302 is ON. Current is supplied from the battery 102 to the coil of the relay 103 through the switch 302 and the starter motor 103 is driven, and the power generator engine is started. If the main switch 301 of the remote controller 300 is turned OFF, the operation of the engine power generator is stopped.

When the engine power generator having the control apparatus is switched to the operable state by the remote controller 300, and if an operator is positioned near the generator 100 it is required to stop the operation of the power generator 100 with the switch disposed on the engine power generator 100 in some cases. When the remote controller 300 is being used, the combination switch 106 is OFF. In such a case, it is only necessary to switch the selector switch 201 of the relay box 200 disposed in the vicinity of the engine power generator 100 is switched to the contact b, i.e., to the side of the engine power generator 100.

When there is no remote controller 300 near the engine power generator 100, an operator who does not well understand the mechanism of the starting/stopping system which is operated using the remote controller tries to turn OFF the main switch, i.e., the combination switch 106 of the engine power generator 100. However, since the combination switch 106 is already turned OFF at that time, it can easily be imaged that the operator confuses and can not swiftly stop the operation. Such confusion arises even for a skilled operator who is used to use the remote controller when the operator does not keep recognition that the engine power generator is being operated by the remote controller.

If an attempt is made to configure a system capable of avoiding the judgment delay of the operator, the wiring and connection of switch between the remote controller and the power generator become complicated.

SUMMARY OF THE INVENTION

It is an object of the invention to provide a control apparatus of an engine-operated machine, which can accurately be operated without complicating wirings between the remote controller and the machine.

A control apparatus defined by claim 1 comprises a starting switch provided on the engine-operated machine body's side for driving the engine starter motor, a remote starting switch which can be operated in parallel to the starting switch, a stopping switch on the body's side for stopping an igniting operation of the engine, a remote stopping switch which can be operated in parallel to the stopping switch, a driving state display lamp which is lit by a power supply only during operation of the body from the body side, and a remote controller provided with the remote starting switch, the remote stopping switch and the driving state display lamp, wherein the remote controller includes, one of terminals of the remote starting switch, one of terminals of the remote stopping switch, one of terminals of the driving state display lamp and a common terminal which connects the other respective terminals of the remote starting switch, the remote stopping switch and the driving state display lamp to each other, and the remote controller is connected to the body of the engine-operated machine through the four terminals.

A control apparatus defined by claim 2 has a feature in which the remote starting switch is of a self-restoring type, the battery is connected to the body's side through the remote starting switch only when the starting switch on the body's side is ON position.

A control apparatus defined by claim 3 has a feature in which the engine-operated machine includes an oil level detecting switch which is operated to maintain a stop state of igniting operation of the engine until the operation is stopped when an oil level of the engine is reduced to a value equal to or smaller than a predetermined value, the remote stopping switch is of a self-restoring type, and connected to the oil level switch in parallel.

A control apparatus defined by claim 4 has a feature in which the oil level-detecting switch maintains the stop state of the igniting operation by a charging state of a discharging time constant circuit, the remote starting switch discharges the electric charge of the discharge time constant circuit when starting operation is carried out.

A control apparatus defined by claim 5 constructed that the engine-operated machine includes a power generator that is driven by the engine, and further comprises a fuel-cut solenoid of the engine such as to form a closed loop with an output winding of the power generator, when the stopping switch on the body's side is ON position, and a self-holding switch that is operated when the remote stopping switch is turned ON is connected to the closed loop in parallel.

According to the present invention, the starting switch and the stopping switch on the body's side are provided with the remote starting switch and the remote stopping switch in parallel. Therefore, when it is desired to stop the engine-operated machine even if the engine-operated machine is being operated by the remote control switch, it is only necessary to operate the stopping switch on the body's side. Further, the number of the long remote controller cables, which connect the remote controller and the body, can be reduced, and the wiring structure in the remote controller can be simplified.

Since the remote starting switch of the remote controller is of the self-restoring type, it is easy to operate the switch, and the discharging circuit by dark current of the battery of the remote controller in the stop state can be eliminated. Although the remote stopping switch is of the self-restoring type, the engine body can reliably be stopped only by pushing the remote stopping switch once.

When the remote starting switch is turned ON immediately after the engine is stopped by the remote stopping switch, a holding of the stop state of the igniting operation is released, and the engine is reliably started by the remote starting switch.

The output winding of the power generator and the solenoid of the closed loop for fuel supply stop are driven when the stopping switch or the remote stopping switch is turned ON, and the fuel supply is continuously stopped while the engine is rotated by inertia. Therefore, even when any one of the stopping switches is operated, the after burning preventing function can be operated.

DETAILED DESCRIPTION OF THE PREFERRED EMBODIMENTS

Figure 2:
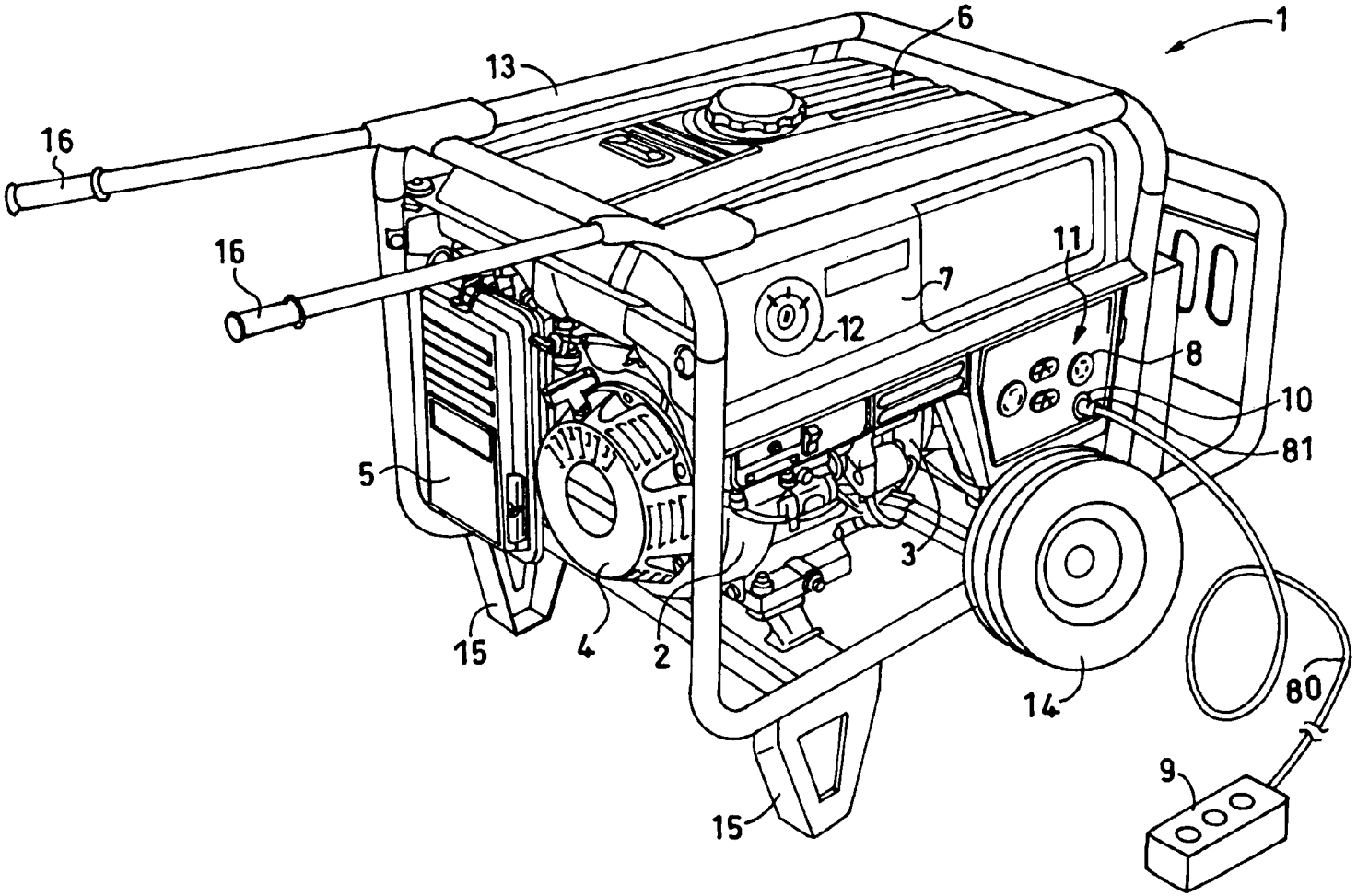
FIG. 2 is a perspective view of the engine power generator of the embodiment of the invention.
Figure 4A:
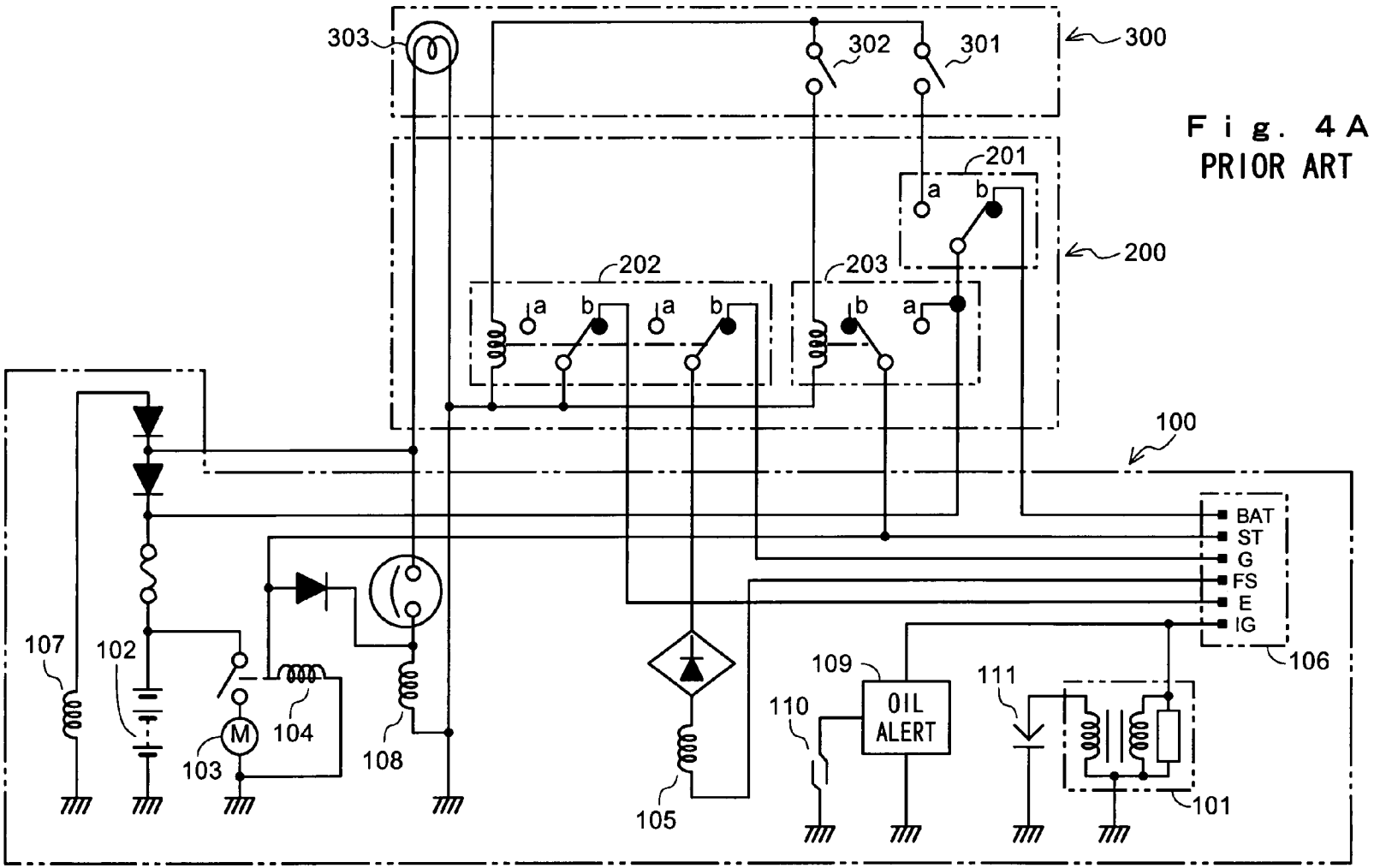
Fig. 4A PRIOR ART
FIG. 4A is a circuit diagram of a conventional engine power generator.

An embodiment of the present invention will be explained in detail with reference to the drawings. FIG. 2 is a perspective view of an entire power generator which is an engine operated machine including a control apparatus of the embodiment of the invention. The engine power generator 1 includes an engine 2 and a power generator body 3 driven by the engine 2 in FIG. 2. A recoil starter 4 is mounted on an end portion of the engine 2. The recoil starter 4 is used for manually starting the engine 2. An intake air cleaner 5 of the engine 2 is provided adjacent to the recoil starter 4. A fuel tank 6 is provided extended over on both of upper portions of the engine 2 and the power generator body 3. The fuel tank 6 is provided at its front surface with an operation panel 7, an output receptacle 8 and a terminal panel 11. The terminal panel 11 includes a connection terminal 10 for a remote controller 9. The operation panel 7 is provided with a combination switch 12 for starting and stopping the engine power generator 1. If a star key is inserted into the combination switch 12 and is turned, the combination switch 12 can be switched. The remote controller 9 includes a cable 80 and a plug 81. The remote controller 9 can operate the engine power generator 1 at a position away from the engine power generator body 3. The length of the cable 80 is 40 m for example.

The engine power generator 1 is mounted on a wheeled frame 13 so that the engine power generator 1 can be transferred. The frame 13 includes wheels 14, stands 15 and bar handles 16.

Figure 1A:
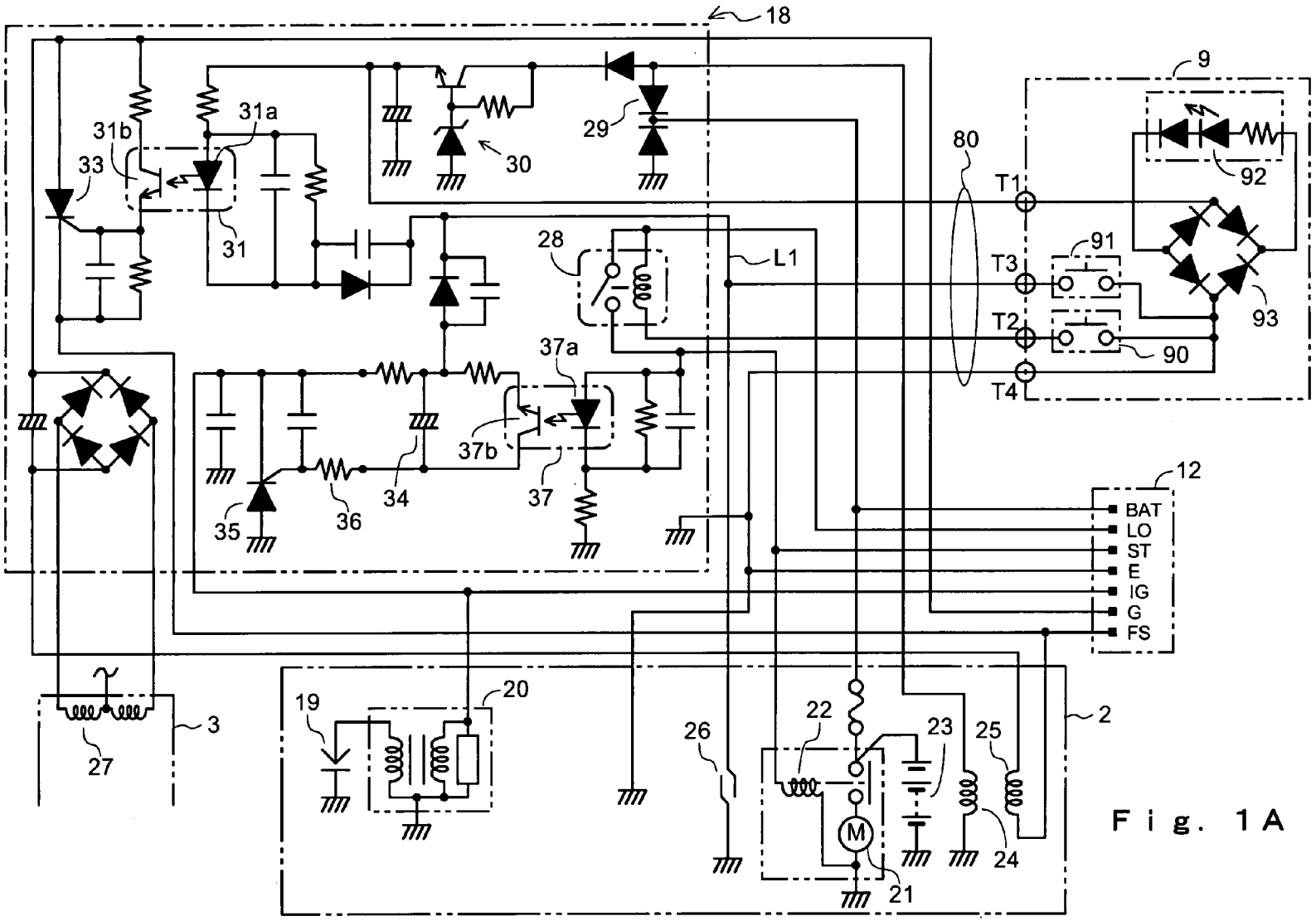
FIG. 1A is a circuit diagram of an engine power generator according to an embodiment of the present invention.
Figures 1B, 3, 4B:
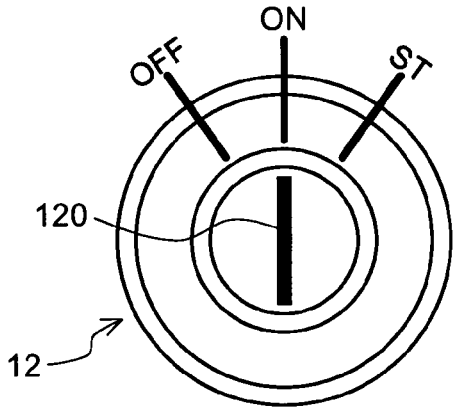
FIG. 1B shows connections of a combination switch of the engine power generator.
FIG. 3 is a front view of the combination switch of the engine power generator of the embodiment of the invention.
FIG. 4B shows connections of a combination switch of the conventional engine power generator.

FIG. 3 is a front view of the combination switch 12. The combination switch 12 has a keyhole 120 into which the star key is inserted. The combination switch 12 is a self-restoring type. The combination switch 12 has three switching positions, i.e., an OFF position (OFF), an ON position (ON) and a starting position (ST). If the position is switched to the OFF position or ON position, the key is fixed at that position, but if the position is switched from the ON position to the starting position and if the operator releases his or her hand, the position is returned to the ON position.

FIG. 1A is a circuit diagram of the primary part of the control apparatus of the engine power generator. The engine power generator 1 including the control apparatus includes the engine 2, the power generator body 3 and the combination switch 12 as explained with reference to FIG. 2, and also includes a controller 18. FIG. 1B shows connection at various switching positions of the combination switch 12.

The engine 2 includes a self-trigger type ignition coil 20, a starter motor 21, a starter motor relay 22, a battery 23, a charge coil 24, a fuel-cut solenoid 25 and an oil level switch 26. A secondary coil of the ignition coil 20 is connected to an ignition plug 19. The ignition plug 19 is ignited by minus electric potential of the ignition coil 20. The power generator body 3 includes a winding 27 for direct current output.

The remote controller 9 includes a starting switch 90, a stopping switch 91, an LED 92 as a display lamp and a rectifier 93 which rectify the current supplied to the LED 92. The starting switch 90 and the stopping switch 91 are self-restoring switches. While an operator turns these switches ON, the switches maintain the ON states, and if the operator stops the ON operation, the switches are returned to OFF states. A terminal T1 is connected to one of inputs of the rectifier 93, and a terminal T2 is connected to one end of the starting switch 90. A terminal T3 is connected to one end of the stopping switch 91. A terminal T4 connects the other input of the rectifier 93, the other end of the starting switch 90 and the other end of the stopping switch 91 to a common ground. The remote controller 9 is connected to the engine power generator 1 through four lines (cables 80) connected to these terminals T1 to T4.

As shown in FIG. 1B, the combination switch 12 is switched such that a terminal BAT connected to the battery 23, a terminal ST connected to the starter motor relay 22 and a terminal LO are connected to each other in the starting position (ST). In the OFF position (OFF), the combination switch 12 connects a terminal IG connected to the ignition coil 20 and a grounding terminal E to each other, and connects a terminal FS connected to the fuel-cut solenoid 25 and a terminal G connected to the winding 27 of the power generator body 3 to each other. At the ON position (ON), the combination switch 12 is switched such that the terminal BAT and the terminal LO are connected to each other.

The operation of the engine power generator 1 can be started and stopped by the combination switch 12. When the combination switch 12 is in the ON position, the operation of the engine power generator 1 can be started and stopped also by the starting switch 90 and the stopping switch 91 of the remote controller 9.

The operation and functions of the various elements will be explained. First, the operation of the engine power generator 1 using the combination switch 12 will be explained. When the combination switch 12 is the ON position, as shown in FIG. 1B, the terminal BAT and the terminal LO are connected to each other and thus, the battery 23 is connected to the relay 28 of the controller 18 through the terminal BAT and the terminal LO. However, if the starting switch 90 of the remote controller 9 is opened, the starter motor 21 is not driven only by switching the combination switch 12 to the ON position.

If the combination switch 12 is switched from the ON position to the start position, the terminal ST in addition to the terminal BAT and the terminal LO are connected to each other as shown in FIG. 1B. Then, the battery 23 is connected to the starter motor relay 22 through the terminal BAT and the terminal ST, and the starter motor relay 22 is energized. As a result, the contact of the starter motor relay 22 is closed, current is supplied to the starter motor 21 from the battery 23, and the starter motor 21 is rotated.

If the starter motor 21 is rotated, the ignition coil 20 generates high voltage to the secondary coil by the self-trigger, and applies the high voltage to the ignition plug 19 connected to the secondary coil. If the engine 2 is started, the charge coil 24 generates electricity, and the battery 23 is charged with the electricity through a diode 29 of the controller 18. Voltage, which is constantly limited by a constant voltage circuit 30, is applied to the rectifier 93, and the LED 92 is driven. At that time, although voltage is also applied to a light-emitting diode 31*a* of a photocoupler 31, since the stopping switch 91 and the oil level switch 26 are opened, current does not flow to the light-emitting diode 31*a*. That is, the phototransistor 31*b* is not turned ON.

If the combination switch 12 is switched to the OFF position to stop the engine power generator 1, since the ignition coil 20 is grounded through the terminal IG and the terminal E, the ignition is stopped. Further, since a closed loop circuit for supplying current to the fuel-cut solenoid 25 from the winding 27 through the terminal G and the terminal FS is formed, current is supplied to the fuel-cut solenoid 25 while the power generator body 3 is rotated by inertia even after the igniting is stopped, and the supply of fuel to the engine 2 is stopped.

Next, a case in which the remote controller 9 is operated to operate the engine power generator 1 will be explained. The remote controller 9 can carry out the starting operation and the stopping operation in a state in which the combination switch 12 is switched to the ON position. First, if the starting switch 90 is pushed, the battery 23 is connected to a coil of the relay 28 through the terminal BAT and the terminal LO of the combination switch 12. Then, the contact of the relay 28 is closed, the coil of the starter motor relay 22 is energized, the contact of the relay 22 is closed, and current is supplied to the starter motor 21 from the battery 23. If the starter motor 21 is rotated, the engine 2 is cranked and started to generate electricity.

When the engine power generator 1 is to be stopped using the remote controller 9, the stopping switch 91 is pushed. Then, a line L1 of the controller 18 assumes grounding potential through the stopping switch 91, current flows to the light-emitting diode 31*a* and the phototransistor 31*b* is turned ON. If the phototransistor 31*b* is turned ON, a gate of a thyristor 33, a closed loop circuit for supplying current to the fuel-cut solenoid 25 from the winding 27 through the thyristor 33 is formed, and supply of fuel to the engine 2 is stopped.

If the line L1 assumes the grounding potential, a capacitor 34 of the controller 18 is charged with minus potential on the side of the line L1. Then, voltage of the capacitor 34 is applied to a gate of a thyristor 35, and the thyristor 35 is conducting. As a result, the ignition coil 20 is grounded positively through the thyristor 35, and the ignition is stopped. Since the capacitor 34 is discharged in accordance with time constant determined by a resistor 36, while the capacitor 34 keeps predetermined electrical charge, the thyristor 35 is turned ON and the stop condition of ignition is maintained. Thus, if the stopping switch 91 is pushed once, the engine can reliably be stopped.

When an oil level is lowered, the oil level switch 26 allows the line L1 to ground to stop the engine 2 like a case in which the stopping switch 91 is pushed. After the oil level switch 26 is once turned ON, the oil level switch 26 is turned OFF by variation of oil level caused by vibration in some cases. However, by the effect of the capacitor 34 and the thyristor 35, the ON state is maintained like the case in which the stopping switch 91 is operated instantaneously, and the OFF state of the switch can be maintained until the engine 2 stops reliably.

When the starting switch 90 is turned ON, a photocoupler 37 allows the capacitor 34 to discharge that the starting operation after the stopping operation can be started early. That is, if the starting switch 90 is turned ON, the relay 28 is energized and its contact is closed, and a light-emitting diode 37*a* is energized. Then, a phototransistor 37*b* is turned ON, and the capacitor 34 immediately discharges.

Although the self-trigger type ignition 101 is used as the ignition in this embodiment, an idea for stopping the supply of igniting energy to the various ignitions such as capacitor discharging type ignition (CDI) can appropriately be used. Although the power generator driven by an engine is explained as an example of a work machine, the control apparatus of the invention is not limited to the engine operated machine and can widely be applied to utility work machines which start and stop the engine using a remote controller.

What is claimed is:

1. A control apparatus for an engine-operated machine including an engine, an engine starting starter motor and a battery, the apparatus comprising:

a starting switch provided on the engine-operated machine body's side for driving the starter motor;

a self-restoring type remote starting switch which can be operated in parallel to the starting switch;

a stopping switch on the body's side for stopping an igniting operation of the engine;

a remote stopping switch that can be operated in parallel to the stopping switch;

a driving state display lamp which is lit by a power supply only during operation of the engine-operated machine from the body side; and a remote controller provided with the remote starting switch, the remote stopping switch and the driving state display lamp, wherein the remote controller includes:

one of terminals of the remote starting switch, one of terminals of the remote stopping switch, one of terminals of the driving state display lamp and a common terminal which directly connects the other respective terminals of the remote starting switch, the remote stopping switch and the driving state display lamp to each other, and the remote controller is connected to the body of the engine-operated machine through the four terminals, and the battery is connected to the body's side through the remote starting switch only when the starting switch on the body's side is ON position.

2. The control apparatus of the engine-operated machine according to claim 1, wherein the engine-operated machine includes an oil level detecting switch which is operated to maintain a stop state of igniting operation of the engine until the operation is stopped when an oil level of the engine is reduced to a value equal to or smaller than a predetermined value, the remote stopping switch is of a self-restoring type, and connected to the oil level switch in parallel.

3. The control apparatus of the engine-operated machine according to claim 2, wherein the oil level-detecting switch maintains the stop state of the igniting operation by a charging state of a discharging time constant circuit, the remote starting switch discharges the electric charge of the discharge time constant circuit when starting operation is carried out.

4. The control apparatus of the engine-operated machine according to any one of claims 1 and 2, wherein the engine-operated machine includes a power generator that is driven by the engine, further comprising;

a fuel-cut solenoid of the engine such as to form a closed loop with an output winding of the power generator, when the stopping switch on the body's side is ON position, and a self-holding switch that is operated when the remote stopping switch is turned ON is connected to the closed loop in parallel.

* * * * *